US006943554B2

(12) United States Patent
Dohi et al.

(10) Patent No.: US 6,943,554 B2
(45) Date of Patent: Sep. 13, 2005

(54) IONIC CURRENT DETECTION APPARATUS FOR INTERNAL COMBUSTION ENGINE

(75) Inventors: Masakazu Dohi, Hyogo (JP); Yoshiyuki Sera, Tokyo (JP); Yasuhiro Takahashi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/644,760

(22) Filed: Aug. 21, 2003

(65) Prior Publication Data

US 2004/0196048 A1 Oct. 7, 2004

(30) Foreign Application Priority Data

Apr. 7, 2003 (JP) ..... 2003-102574

(51) Int. Cl.[7] ..... F02P 17/00

(52) U.S. Cl. ..... 324/378; 324/380; 324/393; 324/399; 73/35.08

(58) Field of Search ..... 324/378, 388, 324/380, 393, 399; 73/35.08

(56) References Cited

U.S. PATENT DOCUMENTS 3,617,866 A * 11/1971 Dowsett et al. ..... 324/330
4,042,132 A * 8/1977 Bohman et al. ..... 414/335
5,347,856 A * 9/1994 Miyata et al. ..... 73/116
5,548,220 A * 8/1996 Kawamoto et al. ..... 324/399
5,895,839 A * 4/1999 Takahashi et al. ..... 73/35.08
6,151,954 A * 11/2000 Aoki et al. ..... 73/35.08
6,202,474 B1 * 3/2001 Takahashi et al. ..... 73/35.08
6,343,500 B1 * 2/2002 Katogi et al. ..... 324/399
6,348,797 B1 * 2/2002 Shimizu et al. ..... 324/399
6,378,494 B1 4/2002 Hatazawa et al.
2003/0116148 A1 * 6/2003 Sakakura ..... 123/630
2004/0085070 A1 * 5/2004 Daniels et al. ..... 324/391

FOREIGN PATENT DOCUMENTS

JP 60-65380 U 5/1985
JP 2001-140740 A 5/2001

* cited by examiner

*Primary Examiner*—Anjan Deb
*Assistant Examiner*—M. Kramskaya
(74) *Attorney, Agent, or Firm*—Sughrue Mion, PLLC

(57) ABSTRACT

An ionic current detection apparatus for an internal combustion engine does not generate a false ionic current, and hence it does not generate a false knock component signal either, thereby avoiding an incorrect combustion determination or an incorrect knock determination. The apparatus detects an ionic current generated in spark plugs connected with secondary sides of a plurality of ignition coils, respectively, each of which generates a high ignition voltage immediately after firing of a corresponding combustion chamber. The ignition coils are arranged in such a manner that at least the directions of adjacent ignition coils do not coincide with one another. In addition, the ignition coils are fixed by a fixture, which has arrangement positions for the ignition coils predetermined according to the mounting directions thereof, in such a manner that the directions of adjacent ignition coils do not coincide with one another, the ignition coils being installed on the engine through the fixture.

5 Claims, 7 Drawing Sheets

[ FIRST CYLINDER ]

[ SECOND CYLINDER ]

[ THIRD CYLINDER ]

[ FOURTH CYLINDER ]

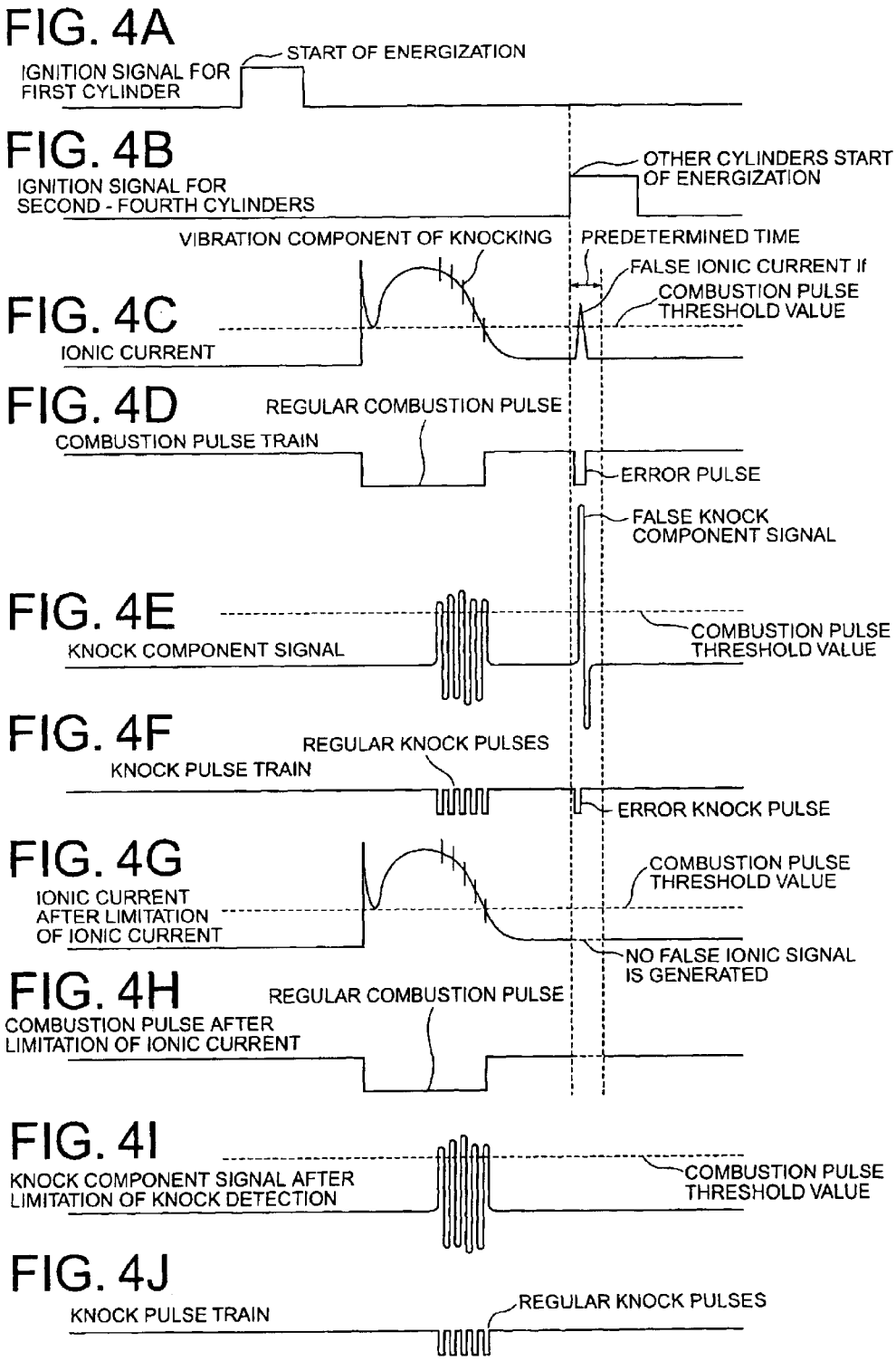
FIG. 4A
START OF ENERGIZATION
IGNITION SIGNAL FOR FIRST CYLINDER
FIG. 4B
OTHER CYLINDERS START OF ENERGIZATION
IGNITION SIGNAL FOR SECOND - FOURTH CYLINDERS
VIBRATION COMPONENT OF KNOCKING
PREDETERMINED TIME
FALSE IONIC CURRENT If
COMBUSTION PULSE THRESHOLD VALUE
FIG. 4C
IONIC CURRENT
FIG. 4D
REGULAR COMBUSTION PULSE
COMBUSTION PULSE TRAIN
ERROR PULSE
FALSE KNOCK COMPONENT SIGNAL
FIG. 4E
COMBUSTION PULSE THRESHOLD VALUE
KNOCK COMPONENT SIGNAL
FIG. 4F
REGULAR KNOCK PULSES
KNOCK PULSE TRAIN
ERROR KNOCK PULSE
FIG. 4G
COMBUSTION PULSE THRESHOLD VALUE
IONIC CURRENT AFTER LIMITATION OF IONIC CURRENT
NO FALSE IONIC SIGNAL IS GENERATED
FIG. 4H
REGULAR COMBUSTION PULSE
COMBUSTION PULSE AFTER LIMITATION OF IONIC CURRENT
FIG. 4I
COMBUSTION PULSE THRESHOLD VALUE
KNOCK COMPONENT SIGNAL AFTER LIMITATION OF KNOCK DETECTION
FIG. 4J
REGULAR KNOCK PULSES
KNOCK PULSE TRAIN

IONIC CURRENT DETECTION APPARATUS FOR INTERNAL COMBUSTION ENGINE

BACKGROUND OF THE INVENTION

1. Field of the Invention

The present invention relates to an ionic current detection apparatus for an internal combustion engine capable of detecting at least the occurrence of misfiring, knocking or the like by detecting a change in the amount of ions generated by combustion of an air fuel mixture in the internal combustion engine.

2. Description of the Related Art

It is generally known that ions are generated when an air fuel mixture is burnt or combusted in cylinders of an internal combustion engine. Thus, using a probe arranged in each cylinder and impressed with a high voltage as a bias voltage, the ions thus generated can be observed as an ionic current. In addition, when there takes place knocking in an internal combustion engine, a vibration component of the knocking is superposed on the ionic current so that the occurrence of the knocking can be detected by extracting this vibration component (for example, see a first patent document: Japanese patent laid-open No. 2001-140740).

However, in the past, in ignition coils in an inline four-cylinder engine for example, the central axis of each ignition coil is arranged in such a manner that it becomes the same direction in which the central axes of adjacent ignition coils are arranged, and the ignition coils are fixed with respect to one another by the use of a holder or the like and then mounted on the engine.

Therefore, when an ignition coil for a cylinder other than the current firing cylinder or an ignition coil for the next firing cylinder is started to be energized, there is generated a false ionic current in the current firing cylinder for which an ionic current is now being detected, indicating as if combustion or knocking has taken place in the current firing cylinder. As a consequence, there arises a problem in that a false knock component signal is generated due to such a false ionic current thus detected, and hence an erroneous combustion pulse is generated due to the false knock pulse at this time, resulting in an incorrect combustion determination or an incorrect knock determination.

SUMMARY OF THE INVENTION

The present invention is intended to solve the problem as referred to above, and has for its object to provide an ionic current detection apparatus for an internal combustion engine which has such an arrangement and construction of ignition coils that no false ionic current and hence no false knock component signal are generated, thus making it possible to prevent an incorrect combustion determination or an incorrect knock determination as well as to improve detection accuracy.

Bearing the above object in mind, the present invention resides in an ionic current detection apparatus for an internal combustion engine, which is capable of detecting an ionic current generated in spark plugs connected with secondary sides of a plurality of ignition coils, respectively, each of which generates a high ignition voltage immediately after firing of an air fuel mixture in a corresponding combustion chamber of the internal combustion engine. The plurality of ignition coils are arranged in such a manner that at least the directions of adjacent ignition coils do not coincide with one another.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIGS. 4(A) through 4(J) are timing charts showing the operation of the first embodiment of the present invention in comparison with the operation of the conventional example.

DESCRIPTION OF THE PREFERRED EMBODIMENTS

Now, preferred embodiments of the present invention will be described below in detail while referring to the accompanying drawings.

Embodiment 1.

Figure 1A:
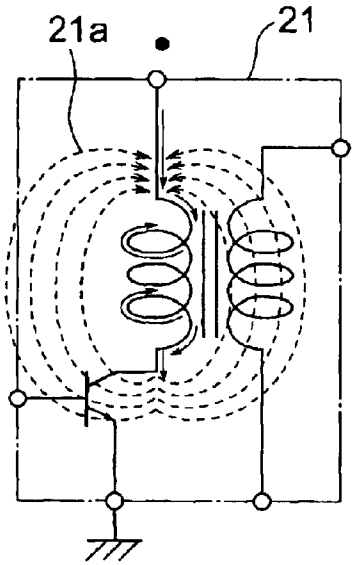
FIGS. 1(A) through 1(D) are explanatory views showing the arrangement and construction of ignition coils in an ionic current detection apparatus for an internal combustion engine according to a first embodiment of the present invention.
Figure 1B:
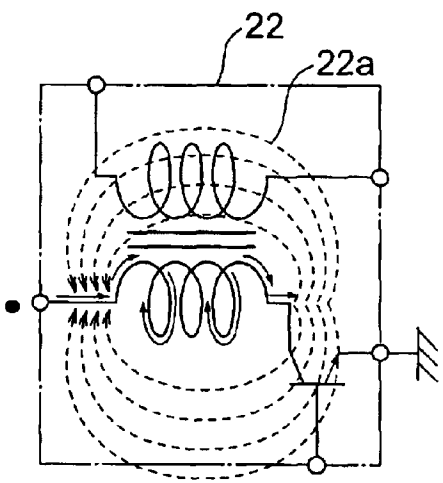
Figure 1C:
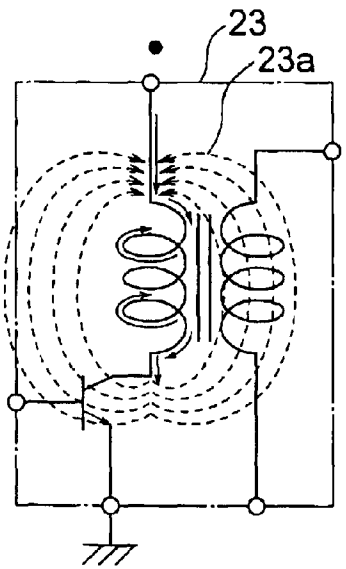
Figure 1D:
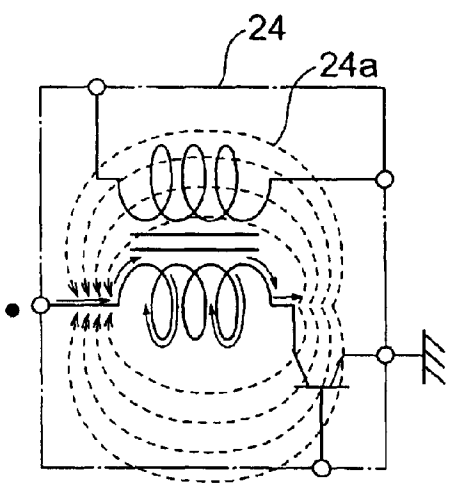
Figure 2:
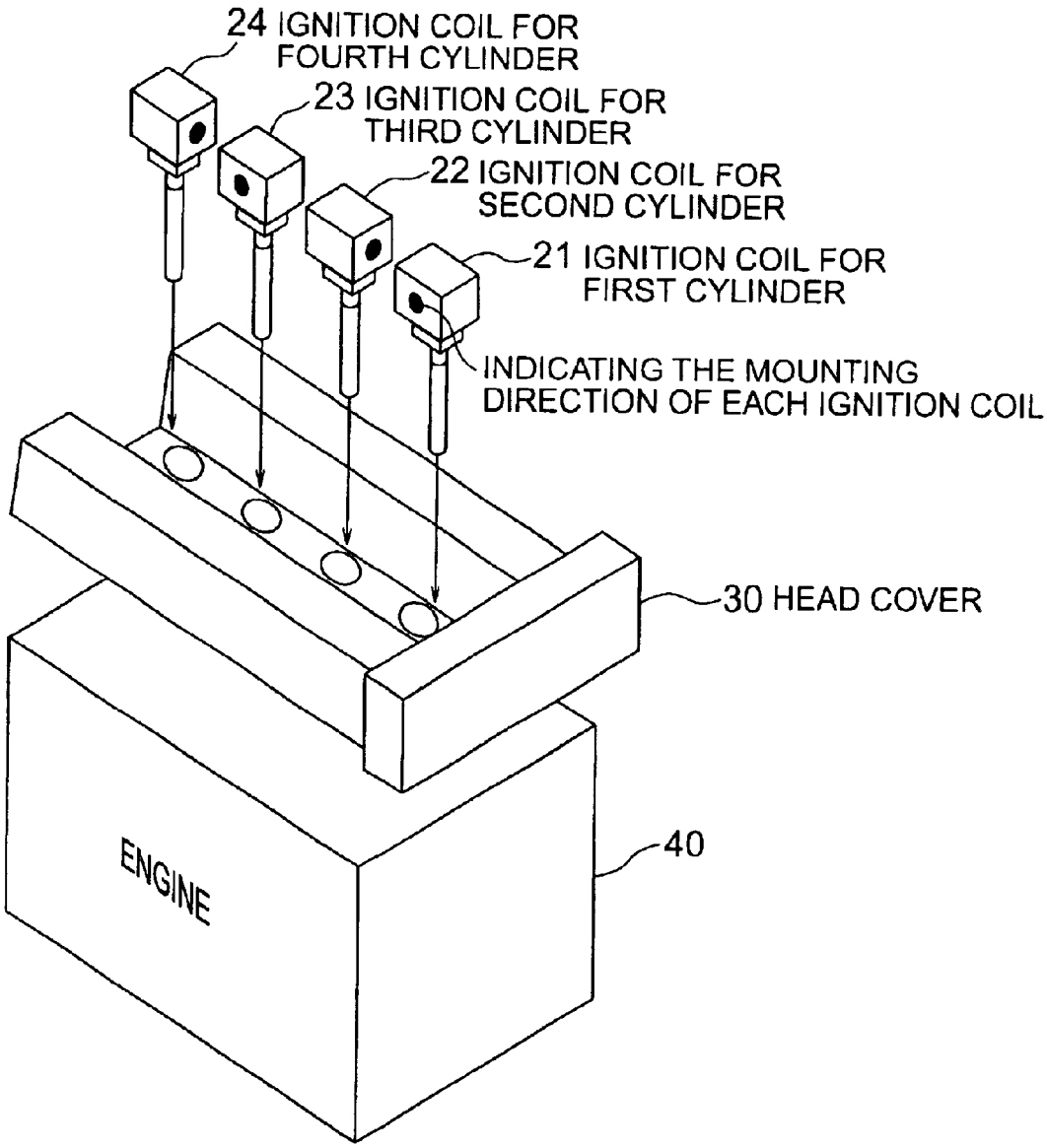
FIG. 2 is a view showing an example in which the ignition coils in the ionic current detection apparatus for an internal combustion engine according to the first embodiment of the present invention are installed on the engine.

FIGS. 1(A) through 1(D) are explanatory views that show the arrangement and construction of ignition coils in an ionic current detection apparatus for an internal combustion engine according to a first embodiment of the present invention. Specifically, these figures illustrate the arrangement and construction of the ignition coils in an inline four-cylinder engine. That is, these figures sequentially indicate the directions of the central axes of ignition coils 21 through 24 for a first cylinder, a second cylinder, a third cylinder and a fourth cylinder, and these ignition coils are arranged in such a manner that the central axes of adjacent ignition coils do not coincide with one another. Filled circle marks indicate the directions of the respective ignition coils to be arranged, and these respective ignition coils 21 through 24 are fixedly fitted in a head cover 30 with their mounting directions corresponding to the directions of the filled circle marks as shown in FIGS. 1(A) through 1(D), and they are installed on an engine 40 through the head cover 30, as shown in FIG. 2.

By arranging the ignition coils 21 through 24 in this manner, it is possible to alleviate the influence of each of magnetic fields 21*a* through 24*a*, which are generated by the respective ignition coils 21 through 24, on the adjacent ignition coils, as shown in FIGS. 1(A) through 1(D). Therefore, there will be no false ionic current generated, as a result of which no false ionic current signal is detected and hence a knock component signal contains a regular or true knock pulse alone.

Figure 3:
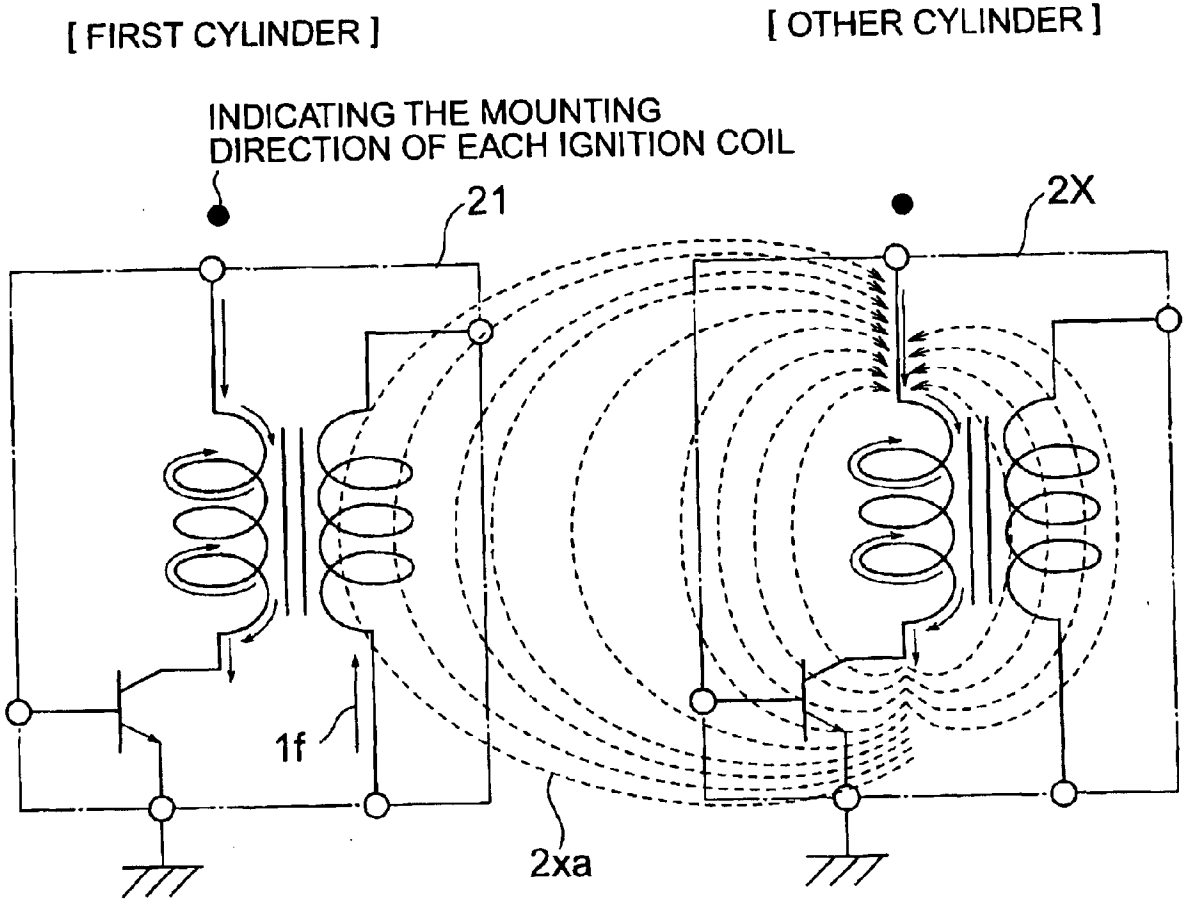
FIG. 3 PRIOR ART
FIG. 3 is a view showing the generation of electromagnetic induction according to the ignition coil arrangement of a conventional example used to explain an operational effect in the first embodiment of the present invention.
Figure 5:
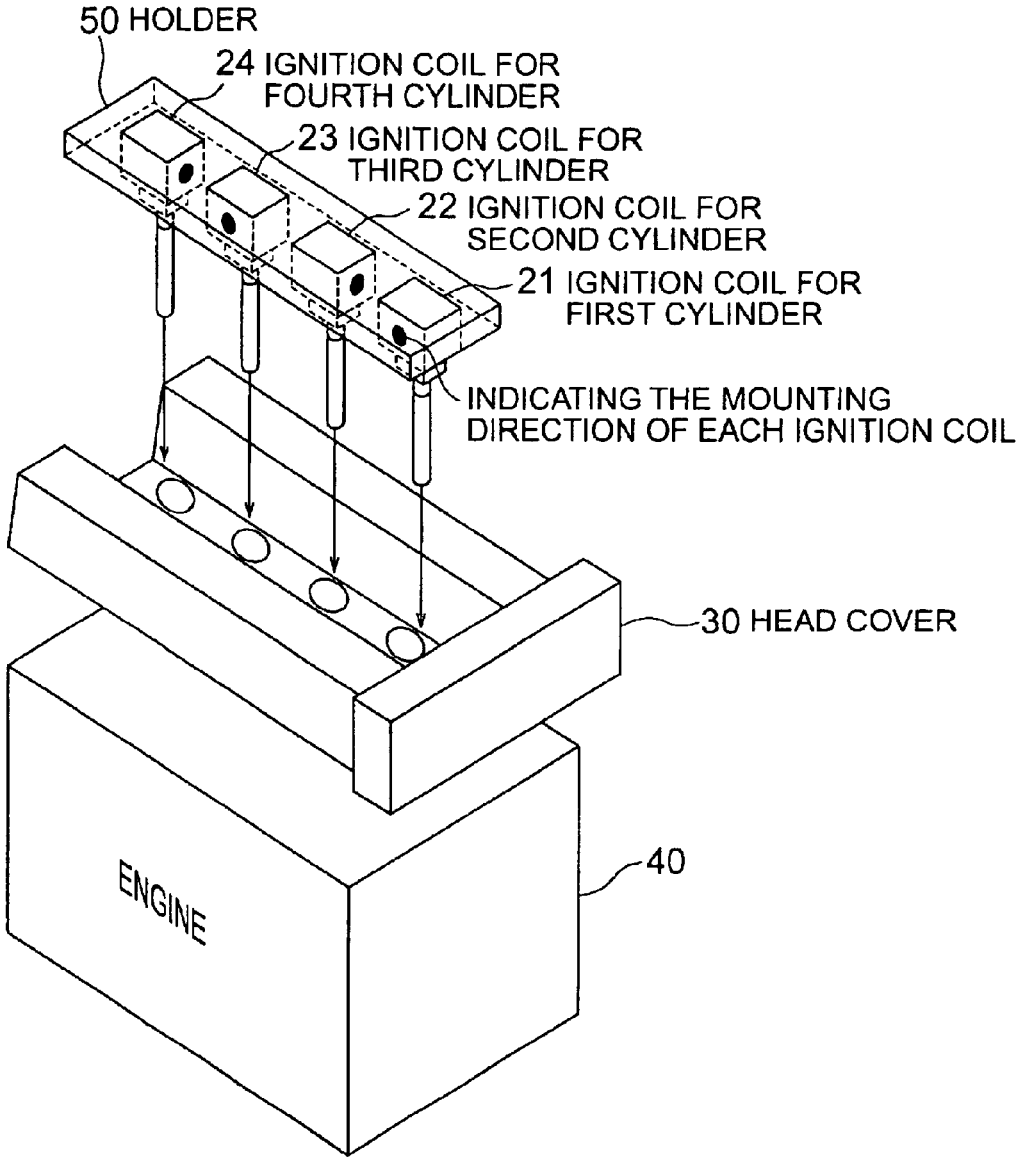
FIG. 5 is a view showing an example in which ignition coils in an ionic current detection apparatus for an internal combustion engine according to a second embodiment of the present invention are installed on the engine.

Hereinafter, the operation and effect of the first embodiment will be explained while referring to FIG. 3 showing the generation of electromagnetic induction due to the arrangement of ignition coils in a conventional example, as well as FIGS. 4(A) through 4(J) showing timing charts in which the operation of the conventional example is compared with that of the first embodiment.

For example, in the inline four-cylinder engine, an ignition signal is supplied to an ignition coil 21 for the first cylinder to start the energization thereof (see FIG. 4(A)). Thereafter, an ignition signal is supplied to an ignition coil 2X for either one of the other cylinders (i.e., the second through fourth cylinders) to start the energization thereof (see FIG. 4(B)). In this case, if an ionic current is detected with an arrangement of the respective ignition coils in which the directions of the ignition coils coincide with one another in the same direction, as in the conventional example, the ignition coil 21 of the first cylinder will be influenced by a magnetic field 2Xa generated when the energization of the ignition coil 2X of another cylinder (i.e., one of the second through fourth cylinders) is started, as shown in FIG. 3. As a result, the ionic current thus detected contains, in addition to an ionic current superposed by the vibration component of knocking, a false ionic current If of a magnitude exceeding a combustion pulse threshold value, which is induced in a direction indicated in FIG. 4(C) under the influence of the magnetic field 2Xa (see FIG. 4(C)).

Moreover, a train of combustion pulses may contain an error pulse due to the false ionic current If in addition to a regular or true combustion pulse (see FIG. 4(D)). The knock component signal can exceeds a knock detection threshold to a great extent (see FIG. 4(E)). At this time, a train of knock pulses contain an error pulse in addition to regular or true knock pulses (see FIG. 4(F)).

Accordingly, the ignition coils 21 through 24 are fixedly fitted in the head cover 30 and installed on the engine 40 through the head cover 30, as shown in FIG. 2, with the directions of the central axes of the adjacent ignition coils being not in coincidence with one another, as shown in FIGS. 1(A) through 1(D). As a result, it is possible to alleviate the influences exerted by the magnetic fields 21*a* through 24*a* generated in the respective ignition coils 21 through 24 on the adjacent ignition coils. Therefore, no false ionic current If will be generated, and hence an ionic current as shown in FIG. 4(G) is generated, as a consequence of which the combustion pulse includes a regular or true combustion pulse alone, as shown in FIG. 4(H), so that no false ionic current signal can not be detected. Thus, the knock component signal becomes the one as shown in FIG. 4(I), and it includes regular or true knock pulses alone, as shown in FIG. 4(J).

Therefore, according to the first embodiment, by arranging the plurality of ignition coils in such a manner that at least the directions of the central axes of mutually adjacent ignition coils do not coincide with one another, no false ionic current is generated, as a consequence of which any false knock component signal is not generated either, and hence an incorrect combustion determination or an incorrect knock determination can be avoided, thereby making it possible to improve the detection accuracy of an ionic current.

Embodiment 2.

In order to hold the arrangement of the above-mentioned ignition coils 21 through 24 when they are mounted to the engine, the ignition coils 21 through 24 are mutually fixed with respect to one another by the use of a fixture in the form of a holder 50, which has arrangement positions for the ignition coils 21 through 24 predetermined according to the mounting directions thereof. As a result, the ignition coils 21 through 24 can be installed on the engine 40 at any time with the arrangement intended by the above-mentioned first embodiment, that is, the arrangement in which the directions of ignition coils among adjacent ignition coils do not coincide with one another.

Here, note that in this second embodiment, the ignition coils directly mounted on the inline four-cylinder engine have been described, but similar effects can be achieved with any engine that employs a plurality of ignition coils, irrespective of the type of the engine, the arrangement positions of the ignition coils, etc.

Figure 6:
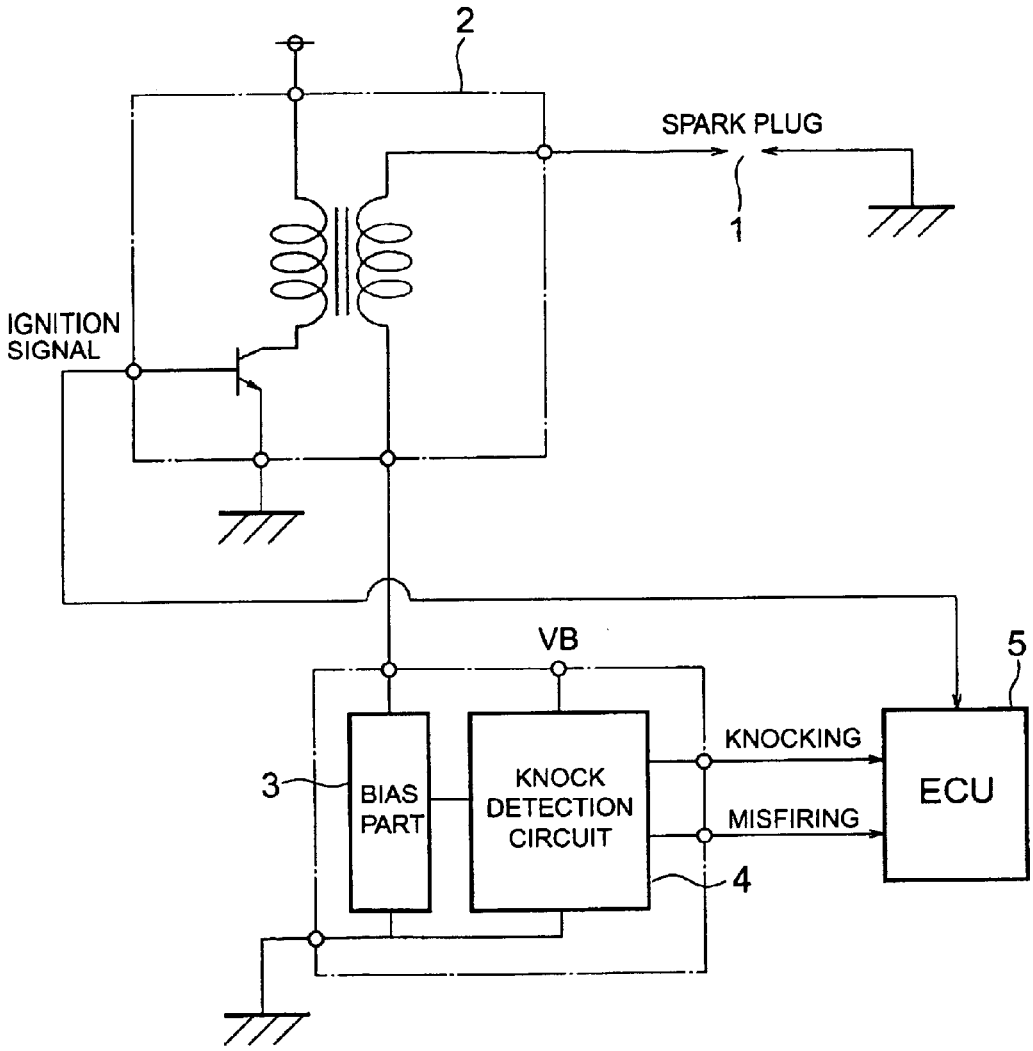
FIG. 6 PRIOR ART
FIG. 6 is a circuit diagram showing a conventional knock detection apparatus (Japanese patent laid-open No. 2001-140740) to which the arrangement and construction of the ignition coils as well as the installation construction thereof on an engine according to the first and second embodiments of the present invention are applied.

FIG. 6 is a circuit diagram that shows a conventional knock detection apparatus (e.g., see Japanese patent laid-open No. 2001-140740) to which the arrangement construction of the ignition coils and the installation construction thereof to the engine in the above-mentioned first and second embodiments are applied. First of all, in this circuit diagram, a spark plug 1 is used as a detection probe for detecting an ionic current. A high voltage (bias voltage) is charged to a bias part 3 for detecting an ionic current by utilizing a secondary voltage of an ignition coil 2. When discharging for ignition is ended, the bias voltage thus charged during the discharging or conducting period is applied to one end of the spark plug 1, so that an ionic current is thereby detected. In this apparatus, a knock detection circuit 4 shapes the waveform of a vibration component extracted from the ionic current into a pulse waveform based on a prescribed threshold value. A variation in the number of pulses of the pulse waveform is arithmetically processed by an electronic control unit (ECU) 5, as a result of which the ignition timing is adjusted to suppress the generation of knocking.

Figure 7:
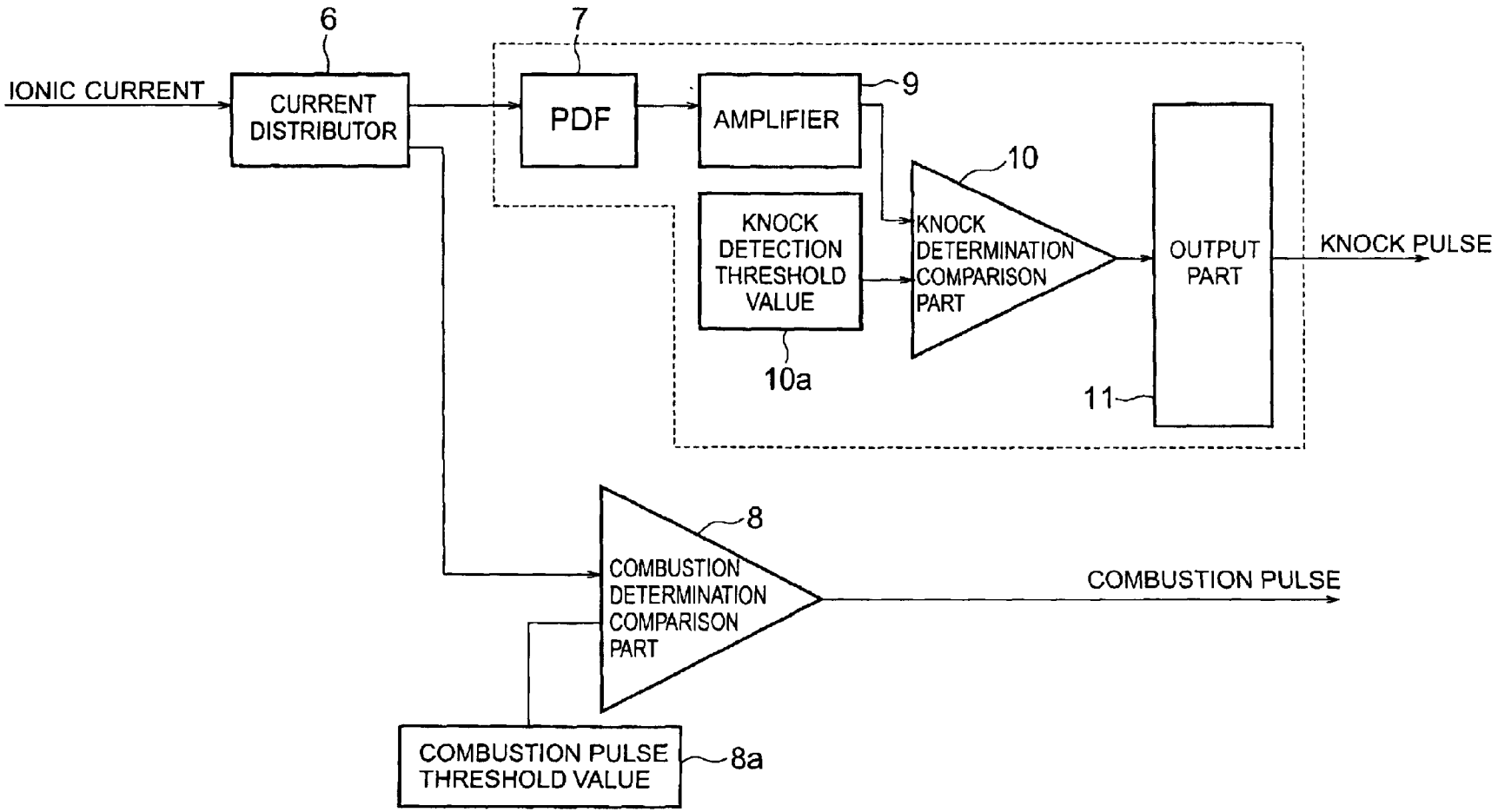
FIG. 7 is a block diagram showing in detail a knock detection circuit 4 of FIG. 6.

In addition, FIG. 7 is a block diagram that shows the details of the above-mentioned knock detection circuit 4. When an ionic current is input to a current distributor 6 under the action of a high voltage applied by the bias part 3, the ionic current is distributed by the current distributor 6 to a band-pass filter (BPF) 7 which serves to extract a knock vibration component, and to a combustion determination comparison part 8 which serves to make a combustion determination. When the ionic current is greater than a prescribed threshold value 8*a*, the comparison part 8 makes a determination that combustion has taken place, and outputs a combustion pulse to the ECU 5 where it is possible to determine the presence of combustion or misfiring based on this pulse.

Also, the knock vibration component, after having been extracted by the BPF 7, is amplified by an amplifier 9. When the vibration component thus amplified is larger than a prescribed threshold value 10*a*, a knock determination comparison part 10 makes a determination that knocking has taken place, and outputs a knock pulse to the ECU 5 through an output part 11.

As described in the foregoing, according to the present invention, by arranging a plurality of ignition coils in such a manner that at least the directions of adjacent ignition coils do not coincide with one another, each ignition coil for a cylinder being detected is not subjected to the influence of electromagnetic induction from the remaining ignition coils for the other cylinders, so that no false ionic current is generated. Consequently, no false knock component signal is generated either, and hence an incorrect combustion determination or an incorrect knock determination can not be performed, thereby making it possible to improve the detection accuracy of an ionic current.

While the invention has been described in terms of preferred embodiments, those skilled in the art will recognize that the invention can be practiced with modifications within the spirit and scope of the appended claims.

What is claimed is:

1. An electronic apparatus for an internal combustion engine comprising:

a plurality of ignition coils, each having a secondary side;

an ionic current detection circuit capable of detecting an ionic current generated in spark plugs connected with secondary sides of said plurality of ignition coils, respectively, each of which generates a high ignition voltage immediately after firing of an air fuel mixture in a corresponding combustion chamber of the internal combustion engine, wherein said plurality of ignition coils are arranged in such a manner that at least the directions of adjacent ignition coils do not coincide with one another.

2. The electronic apparatus for an internal combustion engine as set forth in claim 1, wherein said plurality of ignition coils are arranged in such a manner that the directions of the central axes of ignition coils among adjacent ignition coils do not coincide with one another.

3. The electronic apparatus for an internal combustion engine as set forth in claim 1, wherein said plurality of ignition coils are fixed by a fixture, which has arrangement positions for said ignition coils predetermined according to the mounting directions thereof, in such a manner that the directions of ignition coils among adjacent ignition coils do not coincide with one another, said ignition coils being installed on the engine through said fixture.

4. A combination for an internal combustion engine, comprising:

a plurality of ignition coils, each having a direction defined at least by a central axis; and a fixture, which has arrangement positions for said ignition coils predetermined according to the mounting directions thereof, in such a manner that the directions of ignition coils among adjacent ignition coils do not coincide with one another, said ignition coils being installed on the engine through said fixture.

5. A fixture for holding a plurality of ignition coils, each having a direction defined at least by a central axis, onto an internal combustion engine, comprising:

a frame, and a plurality of coil holding positions, the arrangement positions for said ignition coils being predetermined according to the mounting directions thereof, in such a manner that the directions of ignition coils among adjacent ignition coils do not coincide with one another.

* * * * *